United States Patent [19]

Helms, Jr.

[11] 4,186,857

[45] Feb. 5, 1980

[54] COLLAPSIBLE COAT HANGER

[76] Inventor: Walter C. Helms, Jr., 1001 N. Highland St., Arlington, Va. 22210

[21] Appl. No.: 913,235

[22] Filed: Jun. 6, 1978

[51] Int. Cl.[2] ..... A47J 51/10

[52] U.S. Cl. ..... 223/94

[58] Field of Search ..... 223/94, 89, 95

[56] References Cited

U.S. PATENT DOCUMENTS

| | | | |
|---|---|---|---|
| 890,023 | 6/1908 | Cazier et al. | 223/94 |
| 932,756 | 8/1909 | Cazier | 223/94 |
| 976,531 | 11/1910 | Wilson | 223/89 |
| 2,558,583 | 6/1951 | Robins | 223/94 |
| 3,334,793 | 8/1967 | Anderson | 223/94 |
| 3,705,673 | 12/1972 | Mohammer | 223/94 |

FOREIGN PATENT DOCUMENTS

| | | | |
|---|---|---|---|
| 783806 | 4/1935 | France | 223/94 |

*Primary Examiner*—George H. Krizmanich

*Attorney, Agent, or Firm*—Bacon & Thomas

[57] ABSTRACT

A coat hanger has first and second arms and a hook mutually pivoted on a pin so as to rotate relative to one another for folding from a use configuration to a storage configuration. The pivot pin engages one of the arms through a slot extending in the arm permitting the arm to slide relative to the pin to engage a projection on the arm with an abutment on the other arm, thereby holding the coat hanger in its open configuration.

Near the free end of each arm there is provided a longitudinally extending slot that defines a tab. When the arms are folded the slots mutually engage allowing the arms to overlie one another with the tab of the first arm engaging the outer surface of the second arm while the tab of the second arm engages the inner surface of the first arm. The hook rotates about the pivot so as to lie along the collapsed arms reducing the longitudinal extent of the folded hanger.

21 Claims, 5 Drawing Figures

COLLAPSIBLE COAT HANGER

TECHNICAL FIELD

This invention relates to coat hangers, and more particularly this invention relates to foldable coat hangers.

BACKGROUND AND PRIOR ART

It is frequently desirable to carry coat hangers in luggage in order to hang clothes during trips. In some situations it is desirable to hang the clothes within the luggage, such as for example with hanging bags, and in other situations, it is desirable to have coat hangers available when the luggage is unpacked. In addition, from time to time, it may be desirable to carry a coat hanger on one's person or in a small bag such as a brief case. In all of these situations, it is preferable to have a coat hanger which collapses from an opened configuration for hanging clothes to a folded or closed configuration for storage and portage.

U.S. Pat No. Des. 202,484 dated Oct. 5, 1965 and filed by the applicant discloses a coat hanger having a resemblance to that of the instant invention; however, this design patent does not disclose folding and locking features which enhance portage and use of the coat hanger.

OBJECTS OF THE INVENTION

It is an object of the instant invention to provide a new and improved collapsible coat hanger.

It is a further object of this invention to provide a new and improved collapsible coat hanger which locks in both the open position and in the closed position.

It is a further object of the instant invention to provide a new and improved collapsible coat hanger which is both light in weight and small in size.

It is a further object of the instant invention to provide a new and improved collapsible coat hanger which may be readily carried in luggage, or the like. or on one's person.

It is an object to arrange for the instant invention to be assembled by hand, without requiring use of any mechanical equipment or power.

SUMMARY OF THE INVENTION

With these and other objects in mind, the instant invention contemplates a collapsible coat hanger which is foldable from an open configuration to a closed configuration wherein the coat hanger includes a pair of arms and a hook mutually pivoted about the same pivot point. One of the arms has a slot therein and a projection thereon. The slot registers with the pivot to allow the arm to slide so as to position the projection in engagement with an abutment on the other arm to thereby hold the arms extended for supporting clothes thereon. Additionally, the abutting arm includes a tab overlocking the arm in such manner as to prevent inverting the hanger during the collapsing and folding action. Each arm has an open slot disposed intermediate the ends thereof for receiving a portion of the other arm when the coat hanger is folded to the collapsed configuration. Each slot defines a tab which overlies a portion of the other arm received within the slot so as to frictionally hold the coat hanger closed.

DETAILED DESCRIPTION OF THE PREFERRED EMBODIMENT

Figure 1:
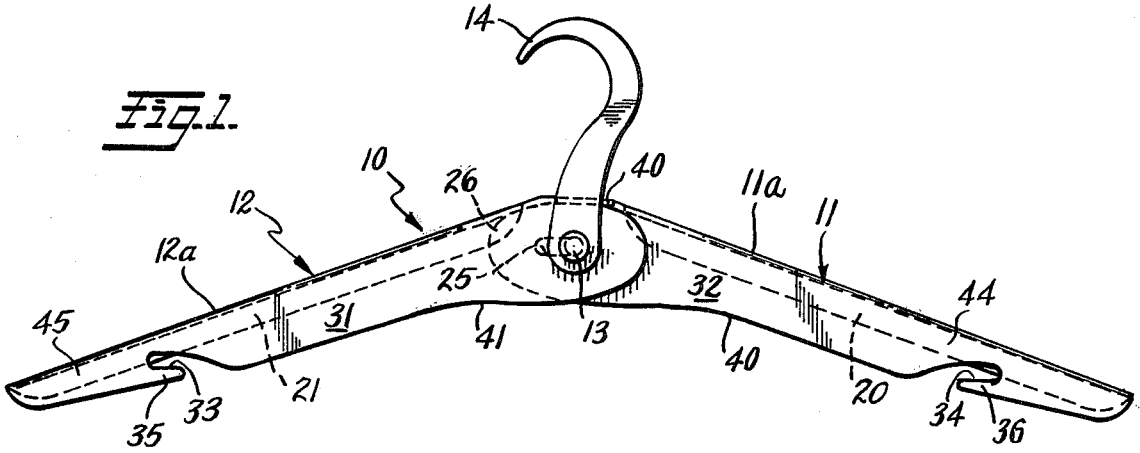
FIG. 1 is a front elevational view of a coat hanger in accordance with the instant invention.
Figure 2:
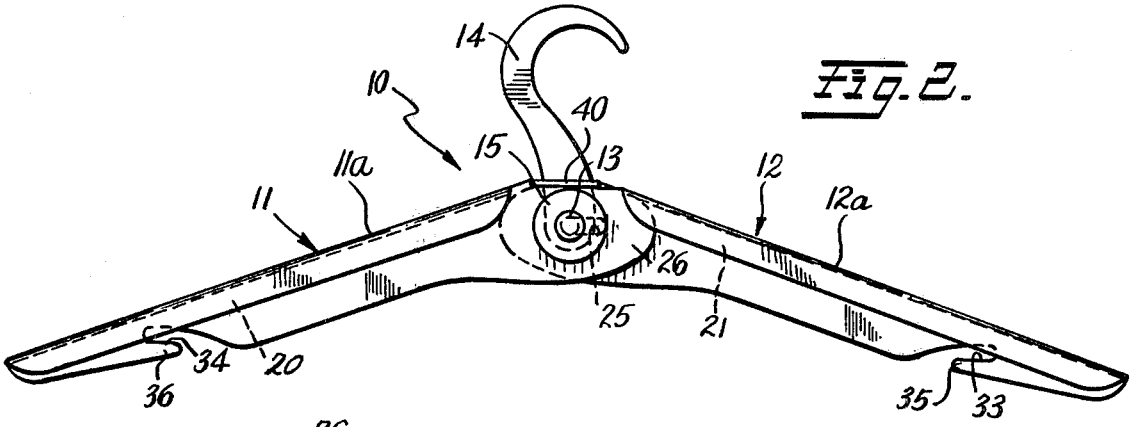
FIG. 2 is a rear elevational view of the coat hanger of FIG. 1.
Figure 3:
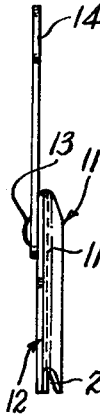
FIG. 3 is an elevational view taken from one end of the coat hanger.
Figure 4:
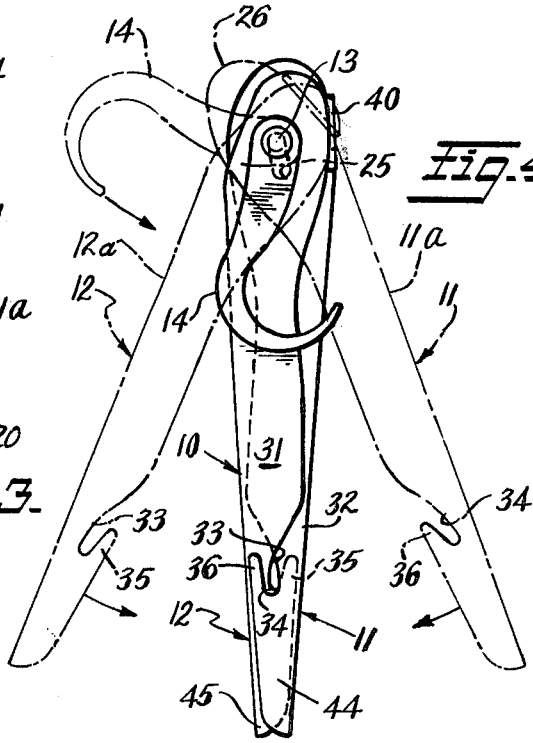
FIG. 4 is a front elevational view of the coat hanger of FIG. 1 showing the coat hanger in a folded configuration and also showing in phantom lines, the elements of the hanger in a partially folded position.
Figure 5:
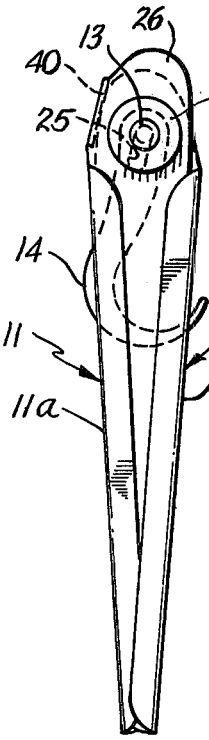
FIG. 5 is a rear elevational view of the coat hanger in the folded configuration.

Referring now to the drawings there is shown a coat hanger 10 which is foldable from an extended configuration shown in FIGS. 1 and 2 to a collapsed configuration shown in FIGS. 4 and 5. As is seen in FIGS. 1 and 2, coat hanger 10 has first and second arms 11 and 12 and a hook 14, which are joined to one another by a rivet or pin 13 so as to pivot about a mutual point. The pin 13 is headed on one end as is seen in FIG. 1 and, as seen in FIG. 2 has a relatively large concave disk or flange 15 rigidly secured to the other end. The pin 15 could be a ball tipped stud that expands upon being forced by hand through the four pieces. The washer 15 is concave so that it bears against the surface of arm 11, maintaining a compressive force and maintaining the hanger in the locked position when moved to the positions of FIGS. 1 and 2, and 4 and 5 while overlying slot 25 in arm 12.

As is best seen in FIGS. 1 and 2, the first and second arms 11 and 12 have top portions **11*a* and 12*a* respectively bent over to form relatively wide smooth surfaces upon which to hang clothes. The bent over top portions 11*a* and 12*a* also form channels 20 and 21 and serve to stiffen the arms 11 and 12** so that they will not readily bend out of the plane generally defined by the coat hanger structure.

As is seen in FIGS. 1, 2, 4 and 5, the first arm 11 has a slot 25 (in dotted lines) through which the pin 13 is received. The first arm also has a projecting portion 26 which is received within the channel 20 of the second arm 12 and abuts the bottom surface of the top portion **12*b* thereby preventing the arm 11 from rotating toward the arm 12. Consequently, when an item of clothing such as a coat or shirt is hung on the hanger, the arms 11 and 12 will remain extended. When one wishes to fold the coat hanger the arm 11 is pulled away from the arm 12 so that the pin 13 moves the right side of the slot 25 and the projection, and the projection 26 clears the top portion 12*a* of arm 12. The arms 11 and 12 can then be rotated toward one another as shown in FIG. 4, in phantom lines so as to assume the configuration of FIGS. 4 and 5. The hook 14 is also pivoted on pin 13 and may be rotated so as to generally align with the folded arms in order to further decrease the length of the folded hanger 10**.

The arms 11 and 12 each have relatively wide planar front portions 32 and 31 which in essence form a front face of the hanger. The portions 31 and 32 have slots 33 and 34 formed therein which are opened to the underside of the hanger and define tabs 35 and 36 respectively. When the hanger is open the slots 33 and 34 and the associated tabs 35 and 36 are used to hang shirts which have a pair of hanging loops thereon. When the hanger 10 is folded, the inboard portion 40 of arm 12 which is in the portion disposed between the slot 34 and pin 13, slides beneath the inboard portion 41 of arm 12 which is disposed between the pin 13 and slot 33. The outboard portion 44 of the arm 11 slides over the corresponding outboard portion 45 of the arm 12 as the slots 33 and 34 receive corresponding areas of the front portions 32 and 31 of the arms 11 and 12. Tab 36 on arm 11 overlies the front surface portion 31 of arm 12 while tab 35 underlies portion 32 of arm 11. By having the inboard section of arm 11 underlie the inboard section of portion 31, while having the outboard portion 44 of arm 11 overlie the outboard portion 45 of arm 12, the arms are skewed slightly in their relationship to one another and therefore tend to frictionally engage one another so as to be held in the collapsed configuration. If one wishes to open the coat hanger, all one need do is pull the free ends of arms 11 and 12 away from one another so that the arms will pivot about pin 13 generally to the position shown in FIGS. 1 or 2. As stated before, the arm 11 is slid toward the arm 12 to position the projection 26 beneath the top portion 12*a* of arm 12 so that the coat hanger will self-lock and will not collapse. When the hook is pivoted to the projected position shown in FIG. 1 extending above the top of the coat hanger, the coat hanger is then ready for use.

The arm 11 has a depending flange 40 projecting at right angles thereto, overlying the end of arm 12 so as to prevent arm 12 from rotating past the position shown in FIGS. 1 and 2 to the 12 o'clock position. The flange 40 projects at a distance substantially equal to the thickness of arm 12 so as not to interfere with the rotation of hook 14.

In order to enhance the appearance of the coat hanger, the flange 15 is in the form of a circular disk which has a diameter great enough to cover the slot 25 when the pin 13 is disposed at either end of the slot. Preferably, the coat hanger is made of aluminum so as to: (1) be light in weight; and (2) be resilient enough to achieve the friction locking or latching relationship previously described and set forth in FIGS. 5 and 6. However, the coat hanger can also be made of plastic or have some plastic parts.

It is apparent from the foregoing discussion that a new and improved collapsible coat hanger has been provided. While only a certain presently preferred embodiment has been described, as will be apparent to those familiar with the art, certain changes and modifications can be made in the preferred embodiment without departing from the scope of the invention as defined by the following claims.

I claim:

1. A collapsible coat hanger comprising:

(a) a pivot pin defining a pivot axis about which the coat hanger collapses;

(b) a first arm having a slot therein which receives said pivot pin wherein said first arm rotates about said pin and slides relative to said pin, said first arm having a projection thereon;

(c) a second arm pivotal about the axis defined by said pin to rotate toward said first arm and having an abutment thereon which is engagable by said projection on said first arm when said first and second arms are slid toward one another when the arms are substantially in the extended configuration, so as to lock said arms with respect to one another; and (d) slot means intermediate the ends of each of said arms wherein the slot means on one arm receives a portion of the other arm to hold the arms in overlapped relationship when the hanger is collapsed; and (e) hook means pivoted on said pin with said arms for extending from said arms when the arms are extended and for overlying said arms when the coat hanger is collapsed.

2. The collapsible coat hanger of claim 1 wherein the coat hanger is made of aluminum.

3. The collapsible coat hanger of claims 1 or 2 wherein the arms each have top portions which are bent over to form channel sections so that the arms will resist bending.

4. The collapsible coat hanger of claims 1 or 2 wherein the arms each have bent over top portions which form channel sections to resist bending and wherein portions of the arms form flat front faces into which said slots extend.

5. The collapsible coat hanger of claims 1 or 2 wherein the arms each have bent over top portions which form channel sections to resist bending and wherein portions of the arms form flat front faces into which said slot means extend, and wherein said slot means define projecting tabs on each of said arms, the tab of the first arm overlying the second arm and the tab of the second arm with the front face portions of each arm received within the slot means of the other arm.

6. A collapsible coat hanger comprising:

(a) a pivot pin defining an axis about which said coat hanger collapses;

(b) a first arm having a slot therein for receiving said pivot pin and longitudinally extending projection thereon;

(c) a second arm pivoted on said pivot pin;

(d) bent over top portions on said first and second arms forming channel sections to strengthen said arms against bending forces and each having relatively wide, flat, front face portions with open slots therein; wherein said projection on said first arm engages beneath the bent over portion of the second arm to support said first arm in extended relationship relative to said second arm wherein said open slot portions in each of said front faces receive the front face portion of the opposing arm with the first arm underlying the second arm between the slots and pivot and overlying the second arm between the slots and arm ends; and (e) a hook pivoted on said pin and rotatable to extend away from said arms when said arms are extended and to extend along said arms when said arms are collapsed.

7. The collapsible coat hanger of claim 6 wherein the coat hanger is made of aluminum.

8. The collapsible coat hanger of claims 1, 2, 6 or 7 wherein the pivot pin is a rivet which is retained by a disk having a concave surface which surface is compressed against the second arm.

9. The collapsible coat hanger of claim 6 further including:

(f) a flange projecting from the first arm for overlying second arm adjacent to the axis about which the coat hanger pivots to prevent the arms from pivoting past the extended position when the projection on the first arm engages beneath the bent over portion of the second arm.

10. The collapsible coat hanger of claim 9 wherein the pivot pin is a rivet which is retained by a disk having a concave surface which surface is compressed against the second arm.

11. The collapsible coat hanger of claim 10 wherein the coat hanger is made of sheet material.

12. The collapsible coat hanger of claim 11 wherein the sheet material is aluminum.

13. A collapsible coat hanger comprising:

(a) a pivot pin means defining a pivot axis about which the coat hanger collapses;

(b) a first arm having a slot therein which receives the pivot pin wherein said first arm rotates about said pin and slides relative to said pin; said first arm including a projecting portion extending in one direction beyond the slot and a bent over portion extending in the other direction away from the slot to form a channel section to both resist bending and to support clothes.

(c) a second arm pivotal only about the pin to rotate toward said first arm, said second arm including a bent over portion extending away from the pin to form a channel section to both resist bending and support clothes and to form a surface beneath which the projection of the first arm abuts when the arms are extended and pushed toward one another to slide the pin in the slot, and (d) flange means on one of the arms overlying the other arm in the vicinity of the pivot axis when the arms are pushed together to prevent the arms from pivoting past the extended position, and (e) hook means pivoted on said pin with said arms for extending from said arms when the arms are extended and for overlying said arms when the coat hanger is collapsed.

14. The collapsible coat hanger of claim 13 wherein the pin pivot pin means is a rivet having a head which abuts the hook and wherein the collapsible coat hanger further includes a retaining disk which has a concave surface for abutting the first arm and covering the slot and which is fixed to the rivet which holds the disk against the first arm in a compressed condition.

15. The collapsible coat hanger of claim 14 wherein the slot is straight.

16. The collapsible coat hanger of claim 15 wherein the flange projects from the first arm toward the hook and is approximately the thickness of the second arm so as not to interfere with the rotation of the hook.

17. The collapsible caot hanger of claim 14 wherein the coat hanger is made of sheet material.

18. The collapsible coat hanger of claim 16 wherein the sheet material is aluminum.

19. The collapsible coat hanger of claim 16 wherein the sheet material is plastic.

20. The collapsible coat hanger of claim 18 wherein the slot is straight.

21. The collapsible coat hanger of claims 13, 14, 15, 16, 17, 18, 19 or 20 wherein there are slots intermediate the ends of each of said arms wherein the slots define projecting tabs on each of said arms, whereby, when the coat hanger is collapsed, the projecting tabs of one arm overlies the other arm while each arm is nested in the slot of the other arm.

* * * * *